US009707428B1

(12) United States Patent
Mitalski

(10) Patent No.: US 9,707,428 B1
(45) Date of Patent: Jul. 18, 2017

(54) MULTIFUNCTIONAL EXERCISE APPARATUSES, SYSTEMS AND METHODS OF USING THE SAME

(71) Applicant: Paul Mitalski, Springfield, IL (US)

(72) Inventor: Paul Mitalski, Springfield, IL (US)

( * ) Notice: Subject to any disclaimer, the term of this patent is extended or adjusted under 35 U.S.C. 154(b) by 250 days.

(21) Appl. No.: 14/084,734

(22) Filed: Nov. 20, 2013

Related U.S. Application Data

(60) Provisional application No. 61/728,337, filed on Nov. 20, 2012.

(51) Int. Cl.
*A63B 21/00* (2006.01)

(52) U.S. Cl.
CPC ..... *A63B 21/00079* (2013.01); *A63B 21/00* (2013.01)

(58) Field of Classification Search
CPC ..... Y10T 24/4093; Y10T 24/4764; A63B 21/1469; A63B 21/062; A63B 21/0724; A63B 21/06; A63B 21/1438; A63B 21/1663; A63B 21/0557; A63B 21/4033; A63B 21/072; A63B 21/0555; A63B 21/151; A63B 21/4017; A63B 21/1654; A63B 21/169; A63B 21/40; A63B 11/2557; A63B 2210/50; A63B 1/00; A63B 21/00047; A63B 21/4035; A63B 71/0054; A63B 2023/006; A63B 21/00; A63B 71/00; A63B 21/00079
USPC ..... 482/139, 23–24, 37
See application file for complete search history.

(56) References Cited

U.S. PATENT DOCUMENTS 4,756,527 A * 7/1988 Ledbetter ..... A63B 21/4017 482/139
5,096,190 A * 3/1992 Montgomery ..... A63B 21/151 482/105
5,518,486 A * 5/1996 Sheeler ..... A63B 21/0004 482/131
6,500,103 B2 * 12/2002 Porter ..... A63B 21/0414 297/468
6,921,354 B1 * 7/2005 Shifferaw ..... A63B 21/068 482/126
7,044,896 B2 5/2006 Hetrick
7,090,622 B2 8/2006 Hetrick
7,458,921 B2 * 12/2008 Hallar ..... A63B 21/0726 482/106
7,651,448 B2 1/2010 Hetrick
7,722,508 B2 5/2010 Hetrick
7,762,932 B2 7/2010 Hetrick
7,785,244 B2 8/2010 Hetrick
7,806,814 B2 * 10/2010 Hetrick ..... A63B 21/0023 482/139
8,007,413 B1 * 8/2011 Wu ..... A63B 21/068 482/131
8,043,197 B2 10/2011 Hetrick
(Continued)

*Primary Examiner* — Andrew S Lo
(74) *Attorney, Agent, or Firm* — Scherrer Patent & Trademark Law, P.C.; Stephen T. Scherrer; Monique A. Momeault

(57) ABSTRACT

The present invention relates to exercise apparatuses, systems and methods of using the same. Specifically, the exercise apparatuses and system utilize one or a plurality of multifunctional straps and grips to provide the ability to use the same in a plurality of ways. The purpose of the present invention is to provide a user with a great number of exercises for strengthening and health that the user can perform anywhere.

13 Claims, 10 Drawing Sheets

(56) References Cited

U.S. PATENT DOCUMENTS 8,083,653 B2 12/2011 Hetrick
8,152,704 B2 * 4/2012 Brice ..... A63B 21/00 482/129
8,197,392 B2 * 6/2012 Silverman ..... 482/904
8,894,556 B2 * 11/2014 Webb ..... A63B 21/062 482/126
8,944,976 B2 * 2/2015 Crowell ..... A63B 21/0442 482/121
2002/0198081 A1 * 12/2002 Chen ..... A63B 21/0004 482/23
2005/0239617 A1 * 10/2005 Tenaglia ..... A63B 21/00043 482/122
2008/0287273 A1 * 11/2008 Ma ..... A63B 21/0552 482/108
2009/0075794 A1 * 3/2009 Hetrick ..... A63B 21/4017 482/139
2009/0253557 A1 * 10/2009 Klein ..... A63B 21/0004 482/38
2009/0275448 A1 * 11/2009 Fishman ..... A63B 21/072 482/139
2010/0173757 A1 * 7/2010 Ma ..... A63B 21/0552 482/93
2011/0098159 A1 * 4/2011 Wiseman ..... A63B 21/0552 482/108
2012/0202662 A1 * 8/2012 DeMarco ..... A63B 1/00 482/143
2012/0220435 A1 * 8/2012 Sweeney ..... A63B 21/0023 482/121
2012/0277074 A1 * 11/2012 Zeldakov ..... A63B 21/154 482/126
2013/0029813 A1 * 1/2013 Hetrick ..... A44B 11/2557 482/139
2013/0143724 A1 * 6/2013 DeMeo ..... A63B 21/00185 482/131
2013/0178345 A1 * 7/2013 Wu ..... A63B 21/068 482/139
2013/0217547 A1 * 8/2013 Hinds ..... A63B 7/00 482/96
2014/0024506 A1 * 1/2014 Vixathep ..... A63B 21/0726 482/108
2014/0073496 A1 * 3/2014 Bannerman ..... A63B 21/0552 482/139
2014/0274569 A1 * 9/2014 Lewen ..... A63B 7/02 482/24
2015/0024908 A1 * 1/2015 Hall ..... A63B 21/0722 482/93

* cited by examiner

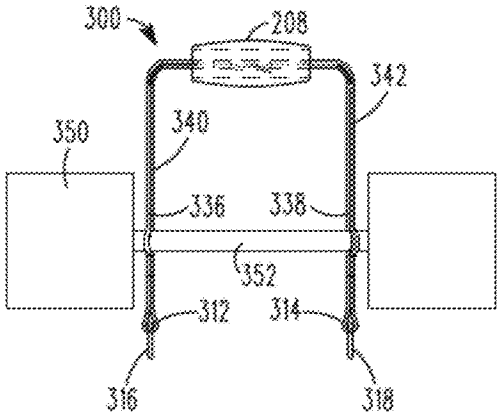
FIG. 14
FIG. 13
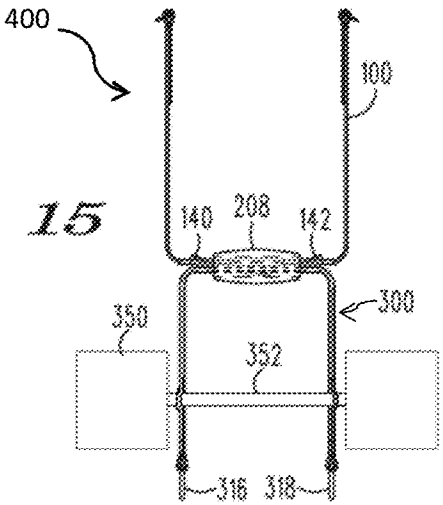
FIG. 15
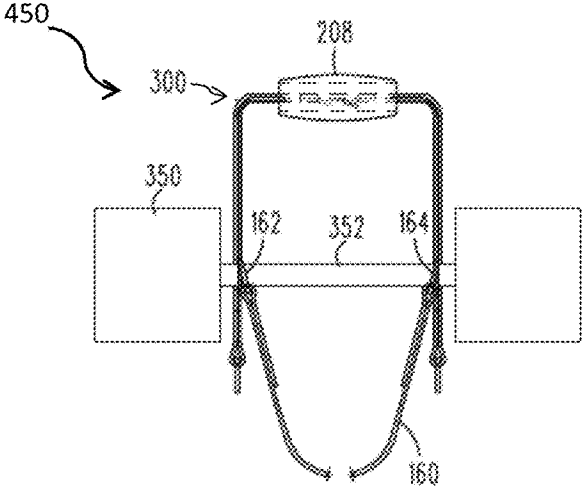
FIG. 16

MULTIFUNCTIONAL EXERCISE APPARATUSES, SYSTEMS AND METHODS OF USING THE SAME

The present invention claims priority to U.S. Provisional Patent Application No. 61/728,337 entitled "Multifunctional Exercise Apparatuses, Systems And Methods Of Using The Same," filed Nov. 20, 2012, which is incorporated herein by reference in its entirety.

TECHNICAL FIELD

The present invention relates to exercise apparatuses, systems and methods of using the same. Specifically, the exercise apparatuses and system utilize one or a plurality of multifunctional straps and grips to provide the ability to use the same in a plurality of ways. The purpose of the present invention is to provide a user with a great number of exercises for strengthening and health that the user can perform anywhere.

BACKGROUND

It is, of course, generally known to perform exercises for the purpose of strengthening muscles and for overall health. Indeed, the production and sale of exercise equipment is a multi-billion dollar industry in the United States and, certainly, around the world. Many people are quite health conscious. However, human lifestyles are somewhat sedentary, in that many people do not get enough exercise due to time and equipment constraints.

Moreover, many people around the world do lead quite active and healthy lifestyles, whether as professional athletes, or merely as part of their normal lifestyles. However, even many athletic and health-conscious individuals yearn for exercise equipment that is less costly, easier to use, requiring less materials and set-up time.

While a user can utilize complicated and expensive machinery to arrive at desired results, it is often the case that an exerciser can obtain significant results by merely using his or her own body weight, simple weights (such as dumbbells, kettle bells, or other like weights) and gravity. Therefore, a need exists for simplified and less costly apparatuses for utilizing gravity and a user's own weight or simple weights to perform desired exercises.

Moreover, a need exists for exercise apparatuses, systems and methods of using the same that provide a user with the ability to perform any number of strengthening exercises. In addition, a need exists for exercise apparatuses, systems and methods of using the same allowing a user to exercise anywhere, from the comfort of his or her own home or workout space, to a gym, to the outdoors.

Further, a need exists for exercise apparatuses, systems and methods of using the same that may present interchangeable exercises to users depending on the user's desired results. Still further, a need exists for exercise apparatuses, systems and methods of using the same that is strong yet flexible to provide sufficient support for a user, yet still allow the user freedom to use the apparatuses and systems in manners desired by the user.

SUMMARY OF THE INVENTION

The present invention relates to exercise apparatuses, systems and methods of using the same. Specifically, the exercise apparatuses and system utilize one or a plurality of multifunctional straps and grips to provide the ability to use the same in a plurality of ways. The purpose of the present invention is to provide a user with a great number of exercises for strengthening and health that the user can perform anywhere.

To this end, in an embodiment of the present invention, an exercising apparatus is disclosed. The apparatus comprises a strap comprising a first end and a second end, a first loop of material at the first end and a second loop of material at the second end, and a first rigid ring or carabiner disposed through the first loop and a second ring or carabiner disposed through the second loop. An adjustment buckle is attached at a midpoint on the apparatus for adjusting the length of the strap.

In an embodiment of the present invention, an exercise apparatus is provided. The exercise apparatus comprises a main strap comprising a first end and a second end; a first loop of material at the first end, wherein a first connector is disposed through the first loop; a second loop of material at the second end, wherein a second connector is disposed through the second loop; and an adjustment buckle disposed at a midpoint of the main strap for adjusting the length of the main strap.

In an embodiment, the strap is reinforced nylon.

In an embodiment, the exercise apparatus further comprises a plurality of hooking loops disposed adjacent the second end.

In an embodiment, the exercise apparatus further comprises a grip strap having a first loop of material on a first end wherein a first connector is disposed through the first loop, and a second loop of material on a second end wherein a second connector is disposed through the second loop, and further wherein the first connector of the grip strap is connectable to the first connector of the main strap and the second connector of the grip strap is connectable to the second connector of the main strap.

In an embodiment, the exercise apparatus further comprises a grip disposed around a midpoint of the grip strap.

In an embodiment, the exercise apparatus further comprises an extension strap having a first loop of material on a first end wherein a first connector is disposed through the first loop, and a second loop of material on a second end wherein a second connector is disposed through the second loop, and further wherein the first end of the grip strap is disposed through the first connector of the extension strap and the second end of the grip strap is disposed through the second connector of the extension strap.

In an embodiment, the extension strap comprises at least two layers, wherein the at least two layers are separable to allow an attachment to be placed through the at least two layers.

In an embodiment, the attachment is selected from the group consisting of a ring, a grip, a strap, a dumbbell, a weight, and a carabiner.

In an embodiment, the main strap is disposed around an object and the first connector and the second connector hang in parallel, further comprising an attachment disposed through the first connector and the second connector of the main strap.

In an embodiment, the main strap is disposed around an object and the second side of the main strap is disposed through the first connector of the main strap such that the main strap surrounds the object, further comprising an attachment disposed through the second connector of the main strap.

In an embodiment, the exercise apparatus further comprises a grip strap having a first loop of material on a first end wherein a first connector is disposed through the first loop, and a second loop of material on a second end wherein a second connector is disposed through the second loop; an extension strap having a first loop of material on a first end, wherein a first connector is disposed through the first loop, and a second loop of material on a second end, wherein a second connector is disposed through the second loop; and a grip, wherein a midpoint of the grip strap and a midpoint of the extension strap are disposed through a hollow portion of the grip, wherein the first connector and the second connector of the grip strap and the first connector and the second connector of the extension strap are connectable to the first connector and the second connector of the main strap.

In an embodiment, the first connector and the second connector are carabiners.

In an alternate embodiment of the present invention, a method of using an exercise apparatus is provided. The method comprises the steps of providing a first main strap comprising a first end and a second end, a first loop of material at the first end wherein a first connector is disposed through the first loop, a second loop of material at the second end wherein a second connector disposed through the second loop, and an adjustment buckle disposed at a midpoint of the first main strap for adjusting the length of the first main strap; providing an object; placing the first main strap over the object; and connecting an attachment to the second connector of the first main strap.

In an embodiment, the method further comprises the steps of placing the second end of the first main strap through the first connector; and pulling the second end of the first main strap until the first main strap cinches around the object.

In an embodiment, the method further comprises the step of connecting an attachment to the first connector of the first main strap.

In an embodiment, the method further comprises the steps of providing a second main strap comprising a first end and a second end, a first loop of material at the first end wherein a first connector is disposed through the first loop, a second loop of material at the second end wherein a second connector disposed through the second loop, and an adjustment buckle disposed at a midpoint of the second main strap for adjusting the length of the second main strap; placing the second main strap over the object; and connecting an attachment to the second connector of the second main strap.

In an embodiment, the method further comprises the steps of placing the second end of the second main strap through the first connector; and pulling the second end of the second main strap until the main strap cinches around the object.

In an embodiment, the method further comprises the step of connecting an attachment to the first connector of the second main strap.

It is, therefore, an advantage and objective of the present invention to provide simplified and less costly apparatuses for utilizing gravity and a user's own weight or simple weights to perform desired exercises.

Moreover, it is an advantage and objective of the present invention to provide exercise apparatuses, systems and methods of using the same that provide a user with the ability to perform any number of strengthening exercises.

In addition, it is an advantage and objective of the present invention to provide exercise apparatuses, systems and methods of using the same allowing a user to exercise anywhere, from the comfort of his or her own home or workout space, to a gym, to the outdoors.

Further, it is an advantage and objective of the present invention to provide exercise apparatuses, systems and methods of using the same that may present interchangeable exercises to users depending on the user's desired results.

Still further, it is an advantage and objective of the present invention to provide exercise apparatuses, systems and methods of using the same that is strong yet flexible to provide sufficient support for a user, yet still allow the user freedom to use the apparatuses and systems in manners desired by the user.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 13 illustrates a strap, dumbbell and grip combination system in an embodiment of the present invention.

FIG. 14 illustrates a strap, dumbbell and alternate grip combination system in an embodiment of the present invention.

FIG. 15 illustrates an alternate strap, dumbbell and grip combination system in an embodiment of the present invention.

FIG. 16 illustrates a further alternate strap, dumbbell and grip combination system in an alternate embodiment of the present invention.

DETAILED DESCRIPTION OF THE PRESENTLY PREFERRED EMBODIMENTS

The present invention relates to exercise apparatuses, systems and methods of using the same. Specifically, the exercise apparatuses and system utilize one or a plurality of multifunctional straps and grips to provide the ability to use the same in a plurality of ways. The purpose of the present invention is to provide a user with a great number of exercises for strengthening and health that the user can perform anywhere.

Figure 1A:
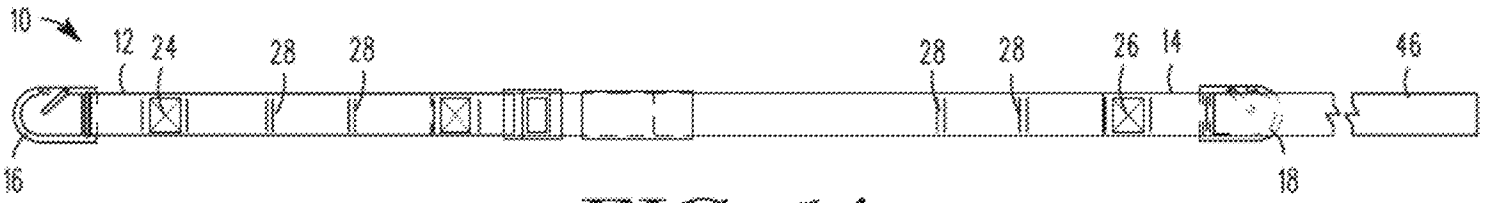
FIGS. 1A-1C illustrate an exercise strap apparatus in an embodiment of the present invention.
Figure 1B:
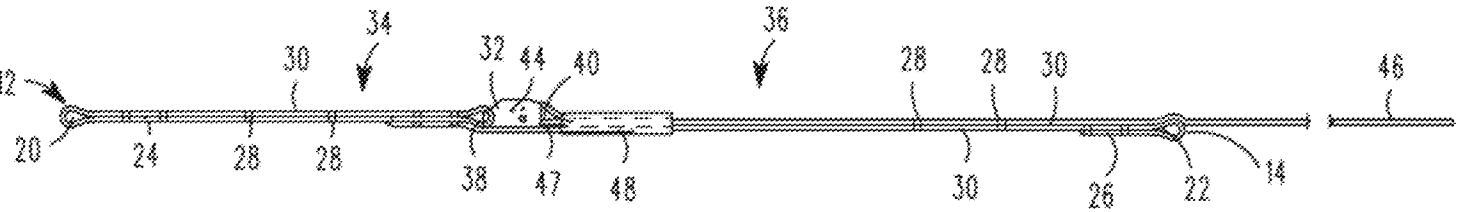
Figure 1C:
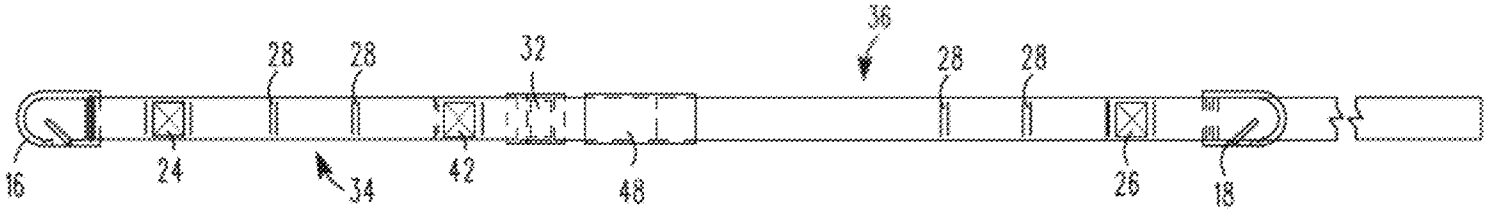

Now referring to the figures, wherein like numerals refer to like parts, FIGS. 1A-1C collectively illustrates a strap 10 utilized for performing exercises in accordance with the present invention. The strap 10 comprises a plurality of features allowing an individual to utilize the strap 10 to perform a plurality of exercises, according to the desires of the user.

Specifically, the strap 10 comprises a first end 12 and a second end 14, having a ring or carabiner 16 disposed on the first end 12 and a second ring or carabiner 18 disposed on the second end 14. The first end 12 may comprise a first loop 20 allowing connection with the ring or carabiner 16 and the second end 14 may comprise a second loop 22 allowing connection with the ring or carabiner 18. The first loop 20 and the second loop 22 may be formed by looping strap material back upon itself forming the loop, and stitching the strap to itself, such as using first and second box stitches 24, 26 for strength and reinforcement of the same. The carabiners 16, 18 may be preferably utilized to attach to any desired mechanism or apparatus, such as grips, handles, weights, pull-sleds, bars, or any other apparatus apparent to one of ordinary skill in the art.

Disposed at various locations on the strap 10 may be single stitches 28 that may allow spaces 30 to be openable between the overlapping strap material and between the single stitches 28 or between the box stitches 24, 26 and the single stitches 28. The spaces 30 may allow the carabiners 16, 18, or any other hook, loop or other attachable connector to be disposed therein to provide an attachment location on the strap 10. For example, the carabiners 16, 18 may be looped back and hooked within one of the spaces 30 to form a large loop that may be utilized to attach to an item, such as a weight for lifting the same, or a bar for hanging the same. As noted, any attachment connector may be connected to carabiners 16, 18, or within spaces 30 between the stitches described herein.

Disposed at a medial location on the strap 10 may be a strap bracket 32 connecting a first section 34 of the strap 10 and a second section 36 of the strap 10 together. The strap bracket 32 may be connected to a first section end 38 and a second section end 40. The first section end 38 may be formed from a loop of strap material and stitched together via a box stitch 42. Thus, the first section end 38 may be permanently mounted and attached to the strap bracket 32. The second section end 40 may be formed from a loop of strap material, but may preferably not be stitched together so that the second section end 40 may be adjustable, allowing the strap 10 to be lengthened or shortened as desired. Biased teeth 44 may engage the second section end 40 to restrict the movement of the same when a desired length of the strap 10 is reached. Slack strap material 46 may extend from the second section end 40 allowing the strap 10 to be lengthened or shortened as desired.

A strap loop sleeve 48 may be provided for housing and retaining a length of strap material 47 extending from the first end 20, thereby covering the strap bracket 32 from beneath, which may allow the strap bracket 32 to not impede, impact or even contact a user of the same, protecting the user when the strap 10 is in use. A rigid material (not shown), such as a length of metal, plastic or the like, may preferably extend from the strap loop sleeve 48 between the strap bracket 32 and the length of strap material 47 to help engage the biased teeth 44 to the second section end 40 when pressure is applied to the same. Otherwise, the biased teeth 44 may slip.

In use, the strap 10 may be attached or connected to a bar, a tree limb, to another strap, to hook, to a loop, to a carabiner on another strap, or to any other means allowing the strap to hang from the same so that a user may perform exercises thereon. The carabiners 16, 18 may extend together to hook to a grip, a weight, or any other apparatus helpful for a user to perform a desired exercise. Alternatively, the strap 10 may be loosely looped through one of the carabiners 16, 18 and cinched to a bar, a tree limb, a grip, or the like for utilizing the same.

In addition, it should be noted that the first loops 20 and 22 may be somewhat removed from box stitches 24 and 26, providing spaces that may be openable between the loops 20, 22 and the box stitches 24, 26, respectively, allowing other attachment means to be disposed therein, such as additional carabiners, hooks, rings, loops from other straps, or any other attachment mechanism apparent to one of ordinary skill in the art.

In use, one or more straps 10 may be attached to another strap (as a single point, for example), a ring, a bar, pole, tree limb, pull sled, or any other apparatus for holding or otherwise utilizing the strap 10 for use in exercise. For example, as noted above, a carabiner 16 or 18 may be used to cinch the strap 10 against a bar or pole. Alternatively, a carabiner 16 or 18 may be connected to one of the spaces 30 between box stitches 24, 26 or between stitches 28. Alternatively, one carabiner 16 may be connected to the other carabiner 18. In addition, one or both of the carabiners 16, 18 may be connected to other straps or to handles, grips, weights or the like to provide a great variation of exercises. The strap 10 may easily be adjustable in length, as described above, allowing for ease of use in any situation.

Alternatively, the strap 10 may be disposed over a bar, pole, tree limb or the like, whereupon both carabiners 16, 18 are disposed freely for attaching items thereto. For example, carabiner 16 may attach to a grip or handle and carabiner 18 may be attached to a weight. A user may utilize the grip or handle and pull downwardly against the weight attached to the carabiner 18 that is pulling downwardly, but from above over the bar, pole, tree limb or the like. Also, the strap 10 may simply be attached to items for pulling the same, such as weighted pull sleds, tires, cars, trucks, or the like for training or otherwise demonstrating feats of strength.

Attached to one or both of carabiners 16, 18 may be a pull rope, strap or the like (not shown) attached to the rounded portion of the carabiner 16, 18 to aid in pulling the carabiner down if cinched to a bar, pole, tree limb or the like. Specifically, the strap 10 may be loosely looped through one or both of the carabiners 16, 18 to form a cinchable loop that may be cinched onto a bar, pole, tree limb, or any other apparatus. Pulling downwardly on the strap 10 may serve to tighten the cinch around the bar, pole or other apparatus. The pull rope, strap or the like may allow the carabiner to be pulled downwardly to loosen the cinch, and may easily allow a user to pull the carabiner down from a high location.

In an alternate embodiment, the strap 10 may include a stopper (not shown) that may be disposed a distance from one of the first end 12 or the second end 14, or from both the first end 12 and the second end 14. Thus, if the strap 10 is loosely disposed through one of the carabiners 16 or 18, the stopper may stop the carabiner from cinching tight on the bar, tree limb, or other apparatus, as described above. Moreover, the stopper (not shown) may also prevent the strap 10 from sliding through a tight space, such as if the strap is disposed through a crack between a door and a door frame. Pulling on the strap 10 may be stopped by the stopper.

It should be noted that the strap 10 may be any size for use by an individual to perform any exercise as desired. For example, the strap 10 may be relatively small or short to be used as a "self-spotting" strap, whereupon the strap may be sized to limit the range of motion of a user, such as if a user attached the strap 10 to a weight, and adjust the length to ensure that the user cannot lower his or her arm below a certain level without the weight touching the ground.

In addition, a system of the present invention may utilize a plurality of straps to expand the range and amount of exercises a user may perform, using one or both arms, legs or the like, depending on the arrangements of the same. Preferably, a user of the present invention may utilize two straps 10 of the present invention to perform a full array of exercises, as desired.

Figure 2A:
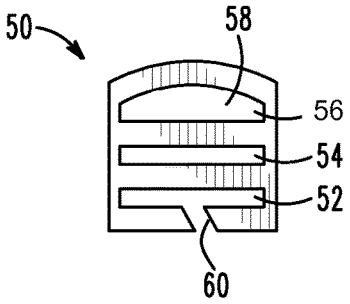
FIGS. 2A-2B illustrate a locking buckle in an embodiment of the present invention.
Figure 2B:
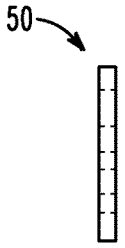

Referring now to FIGS. 2A and 2B, a front view and side view, respectively, or a buckle 50 may be provided. The buckle may be utilized in such a way to allow a strap to have a rigid loop or attachment means in a location on the strap that does not normally have a rigid loop, for attaching the same to another apparatus. Specifically, the buckle 50 may allow a strap material to be threaded through the slits 52, 54 and 56, allowing the open space 58 within slit 56 to be attached to another apparatus, effectively forming a single point of attachment for the strap. Relating the buckle 50 to the strap 10, described above with respect to FIGS. 1A-1C, the buckle 50 may, for example, be utilized with the slack strap material 46 to form another point of attachment on the slack strap material 46 by threading the same through the slits 52, 54 and 56. As detailed in FIG. 2A, the slit 52 may be accessible via a slot 60 disposed therein, allowing strap material to be easily placed therein, such as when threaded therethrough. Thus, the single point of attachment created by the buckle 50 may allow the strap to be pulled from either side of the buckle 50, and the buckle 50 will have locked the strap material therein, not allowing it to move within the buckle 50.

Figure 3A:
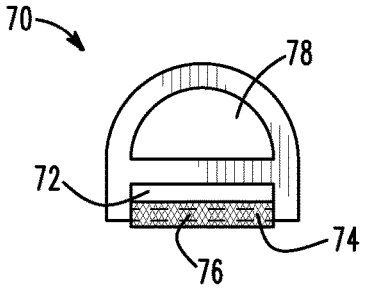
FIGS. 3A-3B illustrate a pulley buckle in an embodiment of the present invention.
Figure 3B:
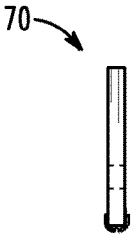

FIGS. 3A and 3B illustrate a pulley buckle 70 of the present invention comprising, generally, a D-ring having a slit 72 disposed on the flat portion thereon. The slit 72 may provide a space for threading a strap material thereinto. However, in contrast to the buckle 50 that locks a strap, the pulley buckle 70 allows two ends of a strap to be used as a pulley. Disposed on an end of the D-ring, specifically on a bar 74 beneath the slit 72 may be a material 76 that may easily rotate. For example, the material 76 may be a nylon material that may provide the dual purpose of providing a grip for the strap material threaded through the slit 72 and providing a rotating surface, allowing the strap material to easily move within the pulley buckle 70. Thus, a strap disposed therein may be utilized as a push-pull mechanism, allowing a user to utilize the same for exercising. Relating the pulley buckle to the strap 10, disclosed in FIGS. 1A-1C, the slack strap material 46 may be threaded through the slit 72 and allowed to slide therethrough, and carabiners 16, 18, for example, may connect to weights, grips or the like, allowing a push-pull exercise using the strap 10. A space 78 in the D-Ring may be utilized, therefore, as a single point of attachment to another apparatus, such as another strap, a ring, a hook or the like.

In an alternate embodiment of the present invention, a strap 100 may be utilized, either alone or in conjunction with the strap 10, or any other strap or apparatus described herein. Specifically, the strap 100 may include a first end 112 and a second end 114, the first end 112 having a first ring or carabiner 116 and the second end 114 having a second ring or carabiner 118 connected thereto, such as within a first loop 120 and a second loop 122 disposed at the first and second ends 112, 114. The first loop 120 may be formed by looping back strap material and stitching the same together using a box stitch 124, or any other fusing mechanism apparent to one of ordinary skill in the art. The second loop 122 may be formed by looping back strap material and stitching the same together using a box stitch 126, or any other fusing mechanism. In a preferred embodiment, the strap 100 may be formed by single piece of continuous strap material from the first end 112 to the second end 114.

Figure 4A:
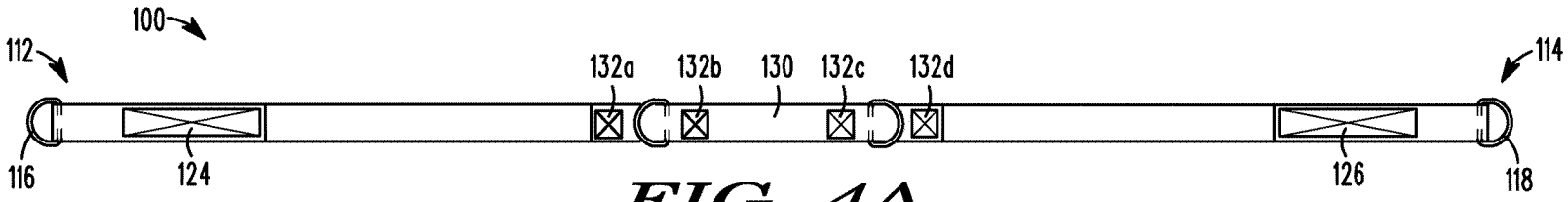
FIGS. 4A-4C illustrates an alternate strap apparatus in an embodiment of the present invention.
Figure 4B:
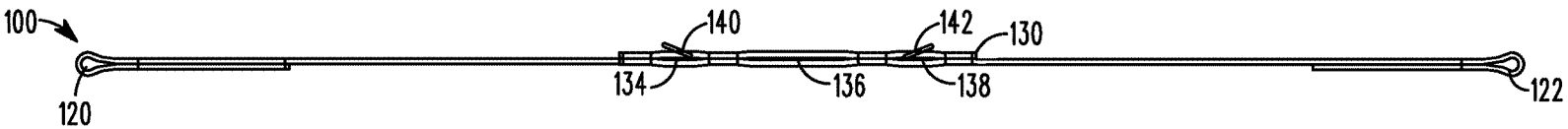
Figure 4C:
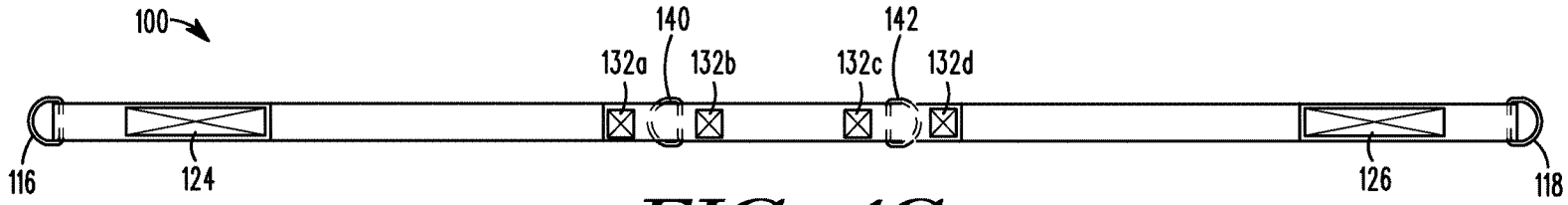

Disposed roughly at a midpoint of the strap 100 may be a second strap material 130 aligned atop the continuous strap material and stitched together at various locations to provide spaces for disposing rings or carabiners therein. Specifically, the second strap material 130 may be fused together with the continuous strap material via box stitches 132*a*, 132*b*, 132*c*, 132*d*, as illustrates in FIGS. 4A-4C. Disposed between box stitches 132*a*-132*d* may be spaces 134, 136 and 138, allowing for rings or carabiners 140, 142 to be disposed therein.

Figure 5:
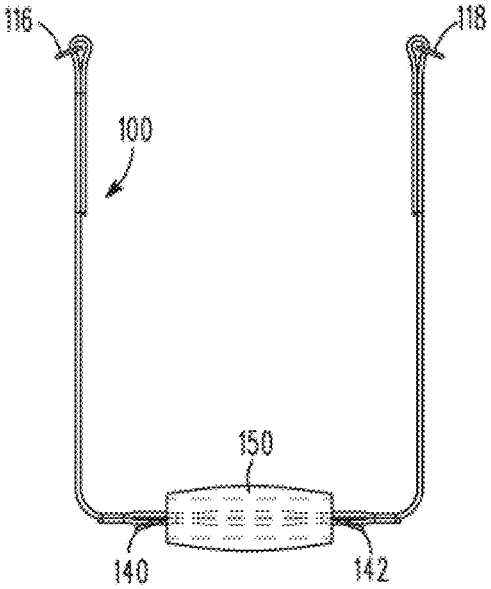
FIG. 5 illustrates a strap and grip system in an alternate embodiment of the present invention.

Thus, strap 100 may have a plurality of ways for items, such as other straps, grips, weights or the like, to be attached thereto. In a preferred embodiment of the present invention, illustrated in FIG. 5, an exemplary use of the strap 100 is demonstrated. Specifically, the rings or carabiners 116, 118 may extend upwardly and may be connected to another strap or apparatus and held aloft to form, roughly, a U-shaped formation. Although the rings or carabiners 116, 118 are not shown attached to anything, it should be apparent that the rings or carabiners 116, 118 may be clipped to anything else, such as a strap 10, as described above and as illustrated in FIG. 17, or anything else to be held aloft, either as a single point of attachment or to two points of attachment where each carabiner 116, 118 attaches independently to another apparatus. A grip 150 may be disposed over the strap 100 and positioned roughly between rings or carabiners 140, 142. Thus, the grip 150 may be utilized by an individual to perform exercises, as desired. The rings or carabiners 140, 142 may be utilized to clip additional straps thereto, including weights, other grips or handles, or even guide ropes or straps. For example, a guide rope or strap may be attached to carabiners 140, 142 and utilized to impart a force that is orthogonal to the downward or upward force that may be provided to the grip 150, thereby creating additional exercise variations, as desired.

Figure 6:
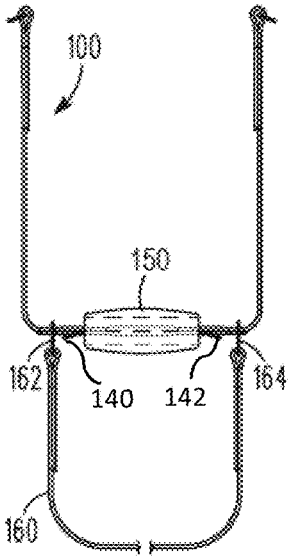
FIG. 6 illustrates a combination strap and grip in a further alternate embodiment of the present invention.

An additional strap 160, as illustrated in FIG. 6, may further be attached on either side of the grip 150, either attached over the strap 100 via its own rings or carabiners 162, 164 or attached to the rings or carabiners 140, 142 on the strap 100. The additional strap 160 may be utilized for additional exercise variations, such as allowing the placement of a user's foot therein for exercises involving the feet or legs. However, if attached over the strap 100 via its own rings or carabiners 162, 164, the range of motion of the strap 160 may be increased and/or optimized, as desired by the user. It should be noted that a plurality of straps 160 may be connected, as shown in FIG. 6, for any other reason apparent to one of ordinary skill in the art.

Figure 7A:
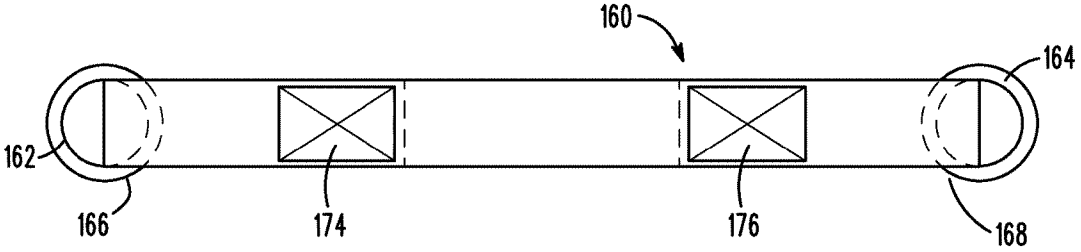
FIGS. 7A-7C illustrate a further alternate strap apparatus in an embodiment of the present invention.
Figure 7B:
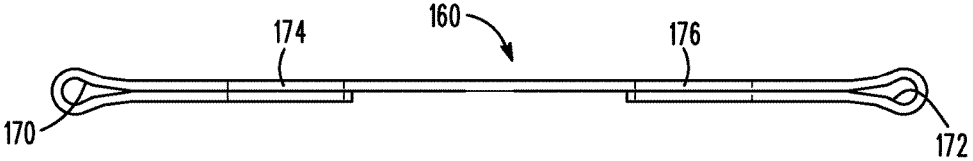
Figure 7C:
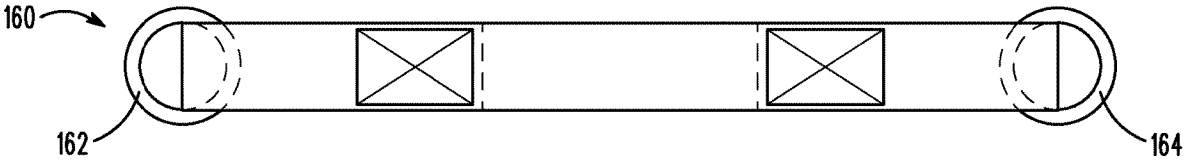

The additional strap 160 is shown in more detail in FIGS. 7A-7C. Specifically, FIGS. 7A-7C illustrates a strap having a first end 166 and a second end 168, with the ring or carabiner 162 and the ring or carabiner 164 disposed in first and second loops 170, 172 on the first and second ends 166, 168, respectively. The loops 170, 172 may be formed by looping strap material and stitching the strap material together using box stitches 174, 176, respectively, or other fusing mechanisms. As noted above, in a preferred embodiment, the strap 160 may be incorporated with the strap 100 to form a multifunctional strap system for providing exercise variations, as desired by a user.

Figure 9:
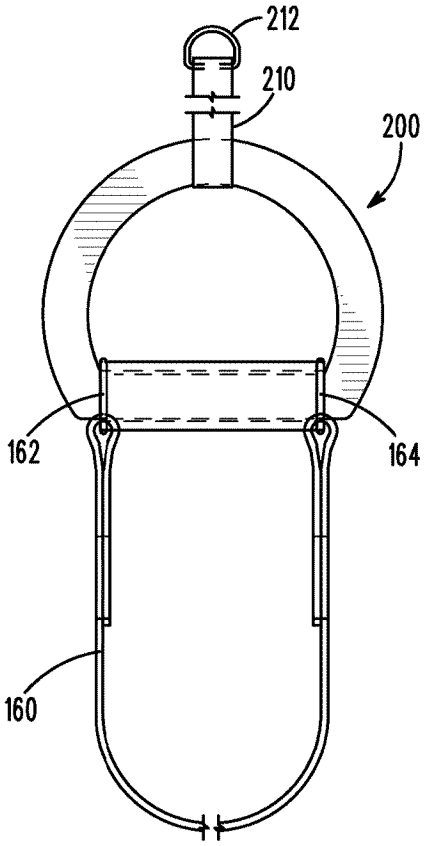
FIG. 9 illustrates an Olympic-style D-ring and grip system in an embodiment of the present invention.
Figure 8:
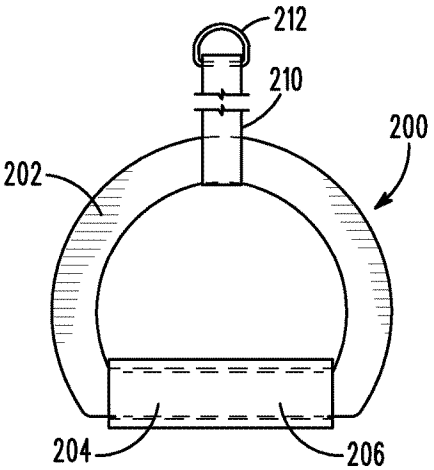
FIG. 8 illustrates an Olympic-style D-ring and grip apparatus in an embodiment of the present invention.
Figure 11:
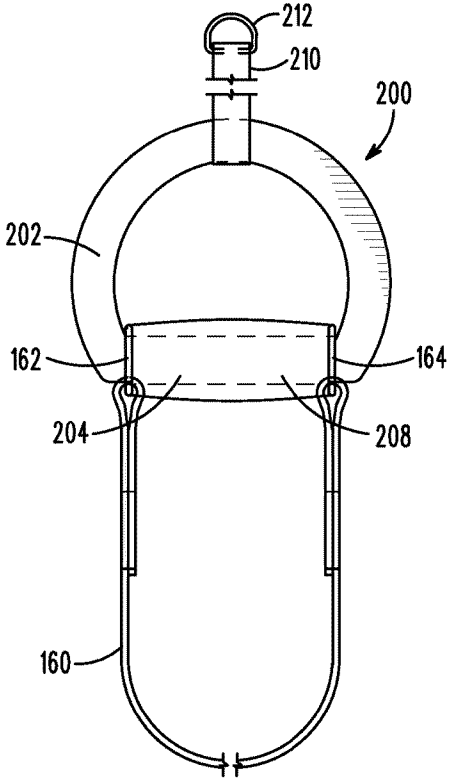
FIG. 11 illustrates an Olympic-style D-ring and alternate grip system in an embodiment of the present invention.
Figure 10:
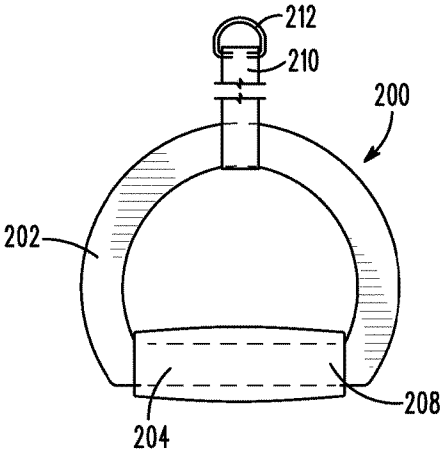
FIG. 10 illustrates an Olympic-style D-ring and alternate grip apparatus in an embodiment of the present invention.

In alternate embodiments of the present invention, FIGS. 8-11 illustrate Olympic-style D-rings 200 that may be utilized as handles, according to the present invention. The Olympic-style D-rings 200 may have a curved top portion 202, and a straight bottom handle portion 204. Of course, the Olympic-style D-rings may be utilized alone as handles, or may have grips 206 (as illustrated in FIGS. 8 and 9), 208 (as illustrated in FIGS. 10 and 11). The D-rings 200 may include a strap 210 disposed upwardly and a ring 212 or carabiner thereon for attaching to another strap or apparatus, as desired.

As illustrated in FIGS. 8 and 9, the grip 206 may have a generally cylindrical shape, and may freely rotate around the straight bottom handle portion 204. The grip 206 may be made from a relatively soft material to provide comfort to a user thereof. Alternatively, the grip 206 may be locked so as not to rotate freely, providing a user with further exercise variations. As illustrated in FIGS. 10 and 11, the grip 208 may be generally cylindrical, but with a curved outwardly curved profile for additional comfort for the user thereof.

Strap 160 may be attached to the Olympic-style D-ring 200 via rings or carabiners 162, 164, as illustrated in FIGS. 9 and 11, allowing strap 160 to be utilized as an extension from the Olympic-style D-rings 200, such as for feet or for any other purpose.

In an alternate embodiment, the strap 160 may be utilized to form a vertical grip for a user desiring that variation in his or her exercise. Specifically, the strap 160 may be folded in half, with rings or carabiners 162, 164 aligned, and the remainder of the strap disposed through a grip 206 or 208. Thus, a loop of the material may extend from one end of the grip 206 or 208, with the carabiners 162, 164 acting as a stop on the other end of the grip 206, 208. The loop of material extending from the one end of the grip 206 or 208 may attach to another strap, or machine, or weight, or the like for providing exercise variation. The rings or carabiners 162, 164 hang from the bottom of the grip 206 or 208, and may be attached to other straps, such as a strap or band for pulling horizontally to provide such exercise variation, or to other weights, grips or the like.

Figure 12A:
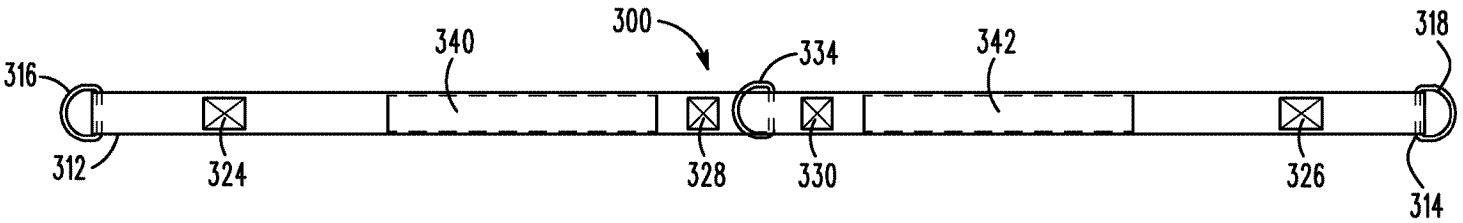
FIGS. 12A-12C illustrates a still further strap apparatus in an alternate embodiment of the present invention.
Figure 12B:
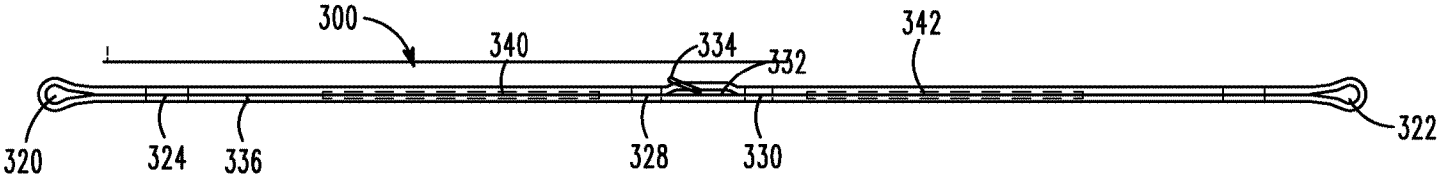
Figure 12C:
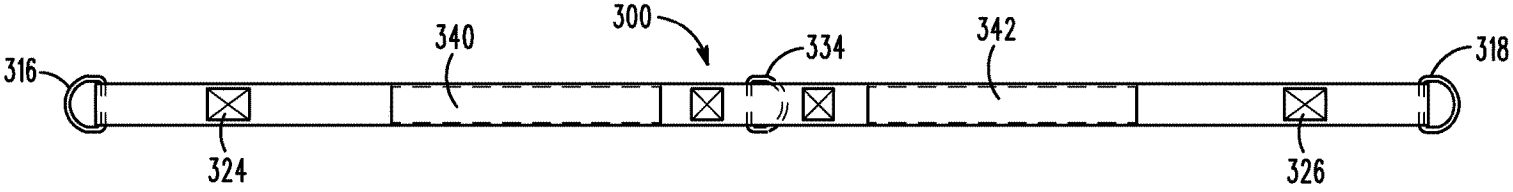

Referring now to FIGS. 12A, 12B and 12C, an alternate strap 300 is illustrated. The strap 300 may have a first end 312 and a second end 314 having rings or carabiners 316, 318 disposed in first and second loops 320, 322, respectively. The first and second loops 320, 322 may be formed by looping the strap material and stitching the same together using box stitches 324, 326, respectively, or any other known fusing methodology. The strap 300 may further be stitched together via box stitches 328, 330 near a middle portion thereof to form a space or open loop 332, having a ring or carabiner 334 disposed therein.

Between box stitches 324 and 328 may be an open space 336 and between box stitches 326, 330 may be an open space 338. However, hook and loop material 340, 342, such as Velcro® or the like, may be disposed on opposing faces of the adjacent strap material within the spaces 336, 338 to bind the strap material together. If desired, one or both of the open spaces 336, 338 may be pulled apart to utilize the open spaces. The hook and loop material 340, 342 may further be used to close upon an apparatus that may be disposed within the open spaces 336, 338, respectively.

In exemplary embodiments illustrated in FIGS. 13 and 14, strap 300 may be utilized with grip 208 (as illustrated in FIG. 13) or grip 206 (as illustrated in FIG. 14) to provide exercise variations to a user thereof. The strap 300 may be utilized with a weight, such as a dumbbell 350. Specifically, the strap may be disposed through the grip 206 or 208 to provide a handle for the user to hold onto. The first and second ends 312, 314 may be disposed downwardly in an upside-down U-formation, and the center bar 352 of a dumbbell 350 may be disposed through open spaces 336, 338 to hold the dumbbell 350 in place while a user utilizes the same for exercising. As illustrated, rings or carabiners 316, 318 may be free to be used with other straps, or may be attached to other apparatuses, as desired by a user thereof. The hook and loop fasteners 340, 342 may be attached together to minimize the spaces 336, 338 to hold the dumbbell 350 in place effectively.

Figure 17:
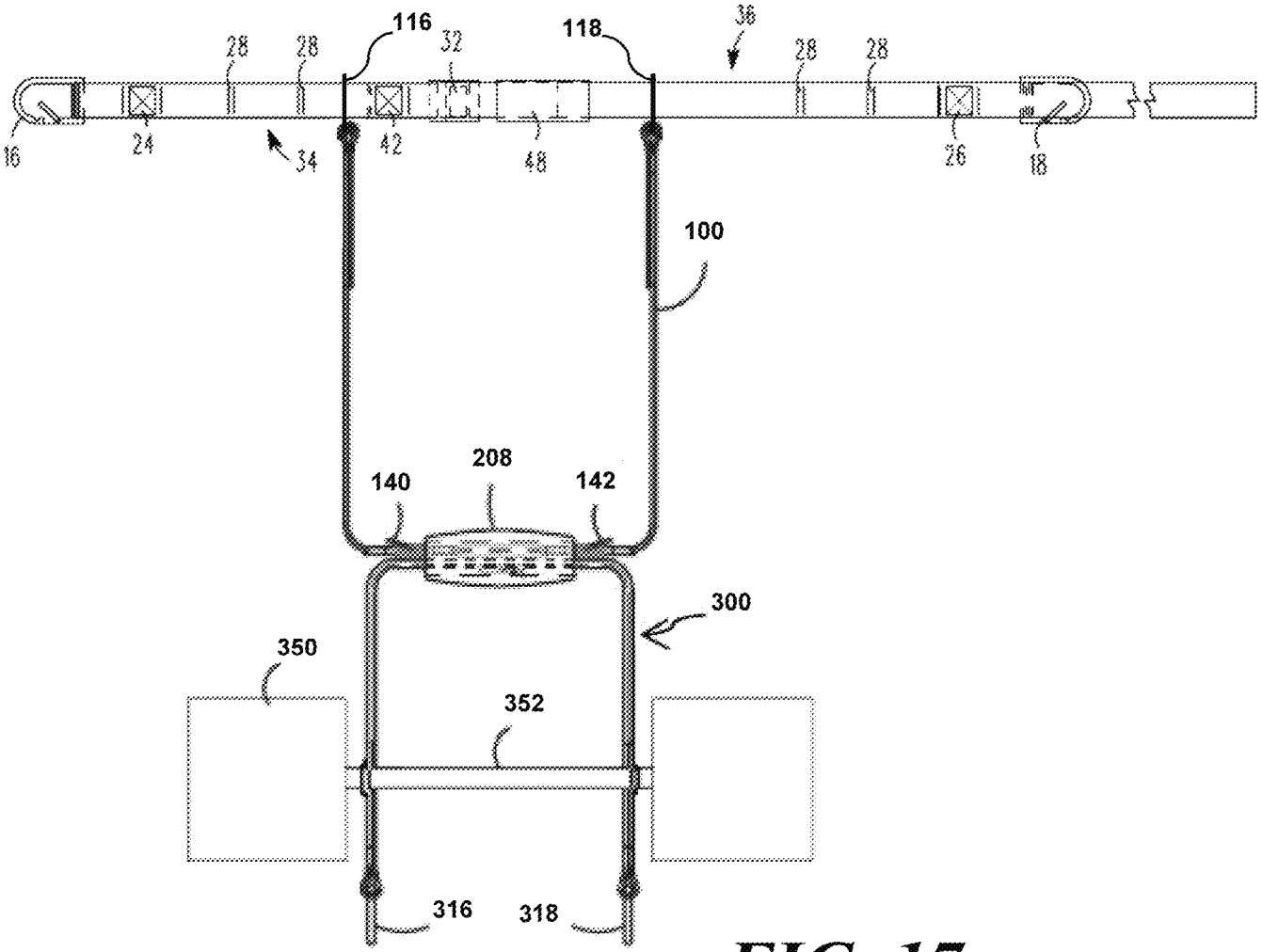

In an alternate exemplary embodiment of the present invention illustrated in FIG. 15, a strap system 400 is illustrated comprising the strap 100 disposed within grip 208, with strap 300 also disposed within grip 208, wherein the strap 100 may be attached to another strap or apparatus upwardly, such as strap 10 as illustrated in FIG. 17, and the dumbbell 350 may be attached to the strap 300, as illustrated in FIG. 13. Thus, forces may be applied against a user in both the upward direction and the downward direction, as desired by the user. For example, the strap 100 may be attached to a strap 10, as described above and as illustrated in FIG. 17, which may be disposed over a bar, pole, tree limb or the like with a weight attached thereto to pull upwardly, while the weight 350 may pull downwardly, creating exercise variation, as desired by the user. In addition, rings or carabiners 140, 142 or 316, 318 may be used to impart additional forces in horizontal directions to create additional exercise variations. Therefore, the grip 208 may be utilized by the user, or the grip of the dumbbell 350 itself may be utilized by the user for performing the exercise.

For example, a user could be beneath the dumbbell 350 pushing upwardly, such as lying on the floor, or otherwise beneath the dumbbell. Specifically, a user may use the dumbbell 350, if rigidly attached above, to pull him or herself up to a seated position, and then further push the dumbbell 350 upwardly over his or her head or in any other direction. A user may be positioned above the dumbbell, such as in a pushup position, and may utilize the hanging dumbbell 350 to do pushups. Alternatively, the user, while beneath, may pull the dumbbell 350 against a weight pulling in the opposite direction. The rings 140, 142 of the strap 100 may be utilized with bands or straps that may pull horizontally in any direction to provide further exercise variation.

In another exemplary embodiment illustrated in FIG. 16, a system 450 is illustrated, utilizing strap 300, grip 208, and dumbbell 350, as shown above with respect to FIG. 13. Strap 160 may further be attached to dumbbell center bar 352 via rings or carabiners 162, 164 to create a U-shaped formation for additional exercises, such as for feet, legs or the like. Thus, the grip 208 may pull upwardly while the weight 350 pulls downwardly. In addition, the grip 208 may pull upwardly while the weight and a foot or leg (not shown) disposed within the U-shaped formation formed by strap 160 pull downwardly.

It should be noted that the straps 10, 100, 160, 300, and any number of the same may be utilized alone or in various combinations according to the present invention, and the present invention should not be limited as described herein.

The straps described herein may be utilized to provide any manner of exercise variations, as desired by a user of the same. As noted above, various grips, handles, weights, or the same may be utilized to provide additional exercise variations. In addition, the straps may be utilized in various configurations attached to other apparatuses, such as exercise machines, bars, poles, tree limbs, pull sleds or any other apparatuses allowing for a large degree of variation in exercises.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are non-limiting, and it should be noted that claim limitations presented herein are not meant to describe the invention as a whole. Moreover, the invention illustratively disclosed herein suitably may be practiced in the absence of any element which is not specifically disclosed herein.

I claim:

1. An exercise apparatus comprising:

a main strap comprising:

a first end and a second end;

a first loop of material at the first end of the main strap, wherein a first connector ring is disposed through the first loop;

a second loop of material at the second end of the main strap, wherein a second connector ring is disposed through the second loop; and an adjustment buckle disposed at a midpoint of the main strap for adjusting a length of the main strap; and a grip strap comprising:

a first loop of material on a first end of the grip strap wherein a third connector ring is disposed through the first loop of the grip strap;

a second loop of material on a second end of the grip strap wherein a fourth connector ring is disposed through the second loop of the grip strap;

a fifth connector ring disposed proximal a midpoint of the grip strap between the third connector ring and the midpoint; and a sixth connector ring disposed proximal the midpoint of the grip strap between the fourth connector ring and the midpoint; and a grip on the grip strap at the midpoint of the grip strap between the fifth and sixth connector rings, wherein the third connector ring of the grip strap is connected to the main strap at a first location on the main strap and the fourth connector ring of the grip strap is connected to the main strap at a second location on the main strap.

2. The exercise apparatus of claim 1 wherein the main strap is reinforced nylon.

3. The exercise apparatus of claim 1 further comprising:

an extension strap having a first loop of material on a first end of the extension strap wherein a seventh connector ring is disposed through the first loop of the extension strap, and a second loop of material on a second end of the extension strap wherein a eighth connector ring is disposed through the second loop of the extension strap, and further wherein the first end of the grip strap is disposed through the seventh connector ring of the extension strap and the second end of the grip strap is disposed through the eighth connector ring of the extension strap.

4. The exercise apparatus of claim 3 wherein the extension strap comprises at least two layers, wherein the at least two layers are separable to allow an attachment to be placed through the at least two layers.

5. The exercise apparatus of claim 4 wherein the attachment is selected from the group consisting of a ring, a grip, a strap, a dumbbell, a weight, and a carabiner.

6. The exercise apparatus of claim 3 wherein the third connector ring and the fourth connector ring of the grip strap and the seventh connector ring and the eighth connector ring of the extension strap are connectable to the first connector ring and the second connector ring of the main strap.

7. The exercise apparatus of claim 1 wherein the first connector ring and the second connector ring are carabiners.

8. A method of using an exercise apparatus, the method comprising the steps of:

providing an exercise apparatus comprising a first main strap comprising a first end and a second end, a first loop of material at the first end wherein a first connector ring is disposed through the first loop, a second loop of material at the second end wherein a second connector ring is disposed through the second loop, and an adjustment buckle is disposed at a midpoint of the first main strap for adjusting the length of the first main strap, the exercise apparatus further comprising a grip strap comprising a first loop of material on a first end of the grip strap wherein a third connector ring is disposed through the first loop of the grip strap, a second loop of material on a second end of the grip strap wherein a fourth connector ring is disposed through the second loop of the grip strap, a fifth connector ring disposed proximal a midpoint of the grip strap between the third connector ring and the midpoint, a sixth connector ring disposed proximal the midpoint of the grip strap between the fourth connector ring and the midpoint, and a grip on the grip strap at the midpoint of the grip strap between the fifth and sixth connector rings, wherein the third connector ring of the grip strap is connected to the main strap at a first location on the main strap and the fourth connector ring of the grip strap is connected to the main strap at a second location on the main strap;

providing an object;

placing the first main strap over the object; and connecting an attachment to the second connector ring of the first main strap.

9. The method of claim 8 further comprising the steps of:

placing the second end of the first main strap through the first connector ring, and pulling the second end of the first main strap until the first main strap cinches around the object.

10. The method of claim 8 further comprising the step of:

connecting an attachment to the first connector ring of the first main strap.

11. The method of claim 8 further comprising the steps of:

providing a second main strap comprising a first end and a second end, a first loop of material at the first end of the second main strap wherein a first connector is disposed through the first loop of the second main strap, a second loop of material at the second end of the second main strap wherein a second connector is disposed through the second loop of the second main strap, and an adjustment buckle is disposed at a midpoint of the second main strap for adjusting a length of the second main strap;

placing the second main strap over the object; and connecting an attachment to the second connector of the second main strap.

12. The method of claim 11 further comprising the steps of:

placing the second end of the second main strap through the first connector; and pulling the second end of the second main strap until the main strap cinches around the object.

13. The method of claim 11 further comprising the step of:

connecting an attachment to the first connector of the second main strap.

* * * * *